United States Patent [19]

Casey et al.

[11] 4,395,786

[45] Aug. 2, 1983

[54] ADJUSTABLE SUPPORT FRAME FOR AN ADJUSTABLE BED OR THE LIKE

[76] Inventors: John D. Casey, 2562 Calle del Oro; Everett Stunz, 1236 Cave St. #3a, both of La Jolla, Calif. 92037

[21] Appl. No.: 269,368

[22] Filed: Jun. 1, 1981

[51] Int. Cl.[3] ..... A61G 7/06

[52] U.S. Cl. ..... 5/66; 5/68

[58] Field of Search ..... 5/60, 66–69

[56] References Cited

U.S. PATENT DOCUMENTS

| | | | |
|---|---|---|---|
| 2,500,742 | 3/1950 | Taylor | 5/69 |
| 2,520,849 | 8/1950 | McVicker | 5/69 |
| 2,631,300 | 3/1953 | Murray | 5/69 |
| 2,747,203 | 5/1956 | Dawson | 5/69 |
| 3,230,554 | 1/1966 | Peterson | 5/66 |
| 3,644,946 | 2/1972 | Swatt | 5/69 X |

*Primary Examiner*—Ramon S. Britts
*Assistant Examiner*—Michael F. Trettel
*Attorney, Agent, or Firm*—Bruno J. Verbeck; Michael L. Slonecker

[57] ABSTRACT

Disclosed herein is an adjustable support frame for an adjustable bed or the like comprising an articulable load-bearing portion having a head element articulably connected to said base, a middle element articulably connected to said head element, and a foot element articulably connected to said middle element. Adjustable support means communicate between said base and each of said middle and foot elements for both supporting said elements over said base as well as for adjusting the position of said elements relative to each other and to said base without affecting the position of said head element relative to said base.

9 Claims, 4 Drawing Figures

ADJUSTABLE SUPPORT FRAME FOR AN ADJUSTABLE BED OR THE LIKE

BACKGROUND OF THE INVENTION

This invention pertains to adjustable beds or the like, and in particular to adjustable support frames therefor of the kind having a base upon which are surmounted a plurality of hinged-together, load-bearing sections forming, respectively, back, thigh, and foot rests.

Adjustable support frames of the foregoing kind are well-known to the art and each employ various types of mechanisms for adjusting the position of the load-bearing sections. An exemplary embodiment of such a frame is disclosed in Peterson, U.S. Pat. No. 3,230,554. Briefly, that patent discloses a supprt frame comprising a base having a back rest section hinged thereto. A thigh rest section is hinged at one end to the adjacent end of the back rest section, and a foot rest section is hinged at one end to the adjacent opposite end of the thigh rest section. A plurality of linking members are connected at one end to the base and at the opposite end to the thigh and foot rest sections to provide support therefor.

The elevating mechanism for adjusting the position of the load-bearing sections comprises a motor, connected to the base, having a threaded axle projecting therefrom which is threadably received by a collar connected to the back rest section.

Because the thigh and foot rest sections are connected to each other and to the back rest section, it is, of course, necessary that the linking members supporting the thigh and foot rest sections be movable in order to allow pivoting movement of the back rest section. Movement of the linking members is provided by hinging each of said members at one end to the base and at the opposite end to the load-bearing section supported by the member.

The primary drawback to frames of the kind just described resides in the fact that their primary degree of adjustability is with respect to the head rest section and only secondarily with respect to the remaining sections as the linking members shift to accommodate head rest section movement. No mechanism is provided for enabling the separate adjustment of the thigh and foot rest sections.

The prior art response to the foregoing drawback has been to incorporate a stationary load-bearing section intermediate the back and thigh rest sections, and then adding a second motor or the like to separately control adjustment of the thigh and foot rest sections. Such a support frame is disclosed in Draper, U.S. Pat. No. 2,996,732.

Insofar as the inventors herein are aware, the prior art has been unsuccessful to date in adapting the general concept disclosed in Draper to support frames of the kind disclosed in Peterson and to which this invention relates.

In view of the foregoing, it is a general object of this invention to provide a new and useful adjustable support frame having means therein for adjusting the position of the back rest section, as well as means for adjusting the position of the thigh and foot rest sections without affecting the positioning of the back rest section.

Still further, it is an object of this invention to provide a device of simplified construction which accomplishes the foregoing general object, thereby producing a device of reduced cost and increased mechanical reliability.

SUMMARY OF THE INVENTION

Briefly stated, the foregoing and other objects of this invention are obtained by the addition of adjustable support means communicating between said base and each of said thigh and foot rest sections. More specifically, said means in its preferred form comprises a scissor-like mechanism having a first member hinged at one end to said base and abutted at its opposite end against one of said thigh and foot rest sections. Connected by a hinge to said first member is a second member which is abutted at its opposite ends, respectively, against said base and the other of said thigh and foot rest sections. Connected to said base and one of said first and second members is a motor or the like for controllably raising or lowering the thigh and foot rest sections supported by said members.

A characterizing feature of said adjustable support means is that the various junctures of abuttment are movable and, therefore, said thigh and foot rest sections may be controllably moved to various positions of adjustment without affecting the positioning of the back rest section. Similarly, because the junctures of abutment are movable, the back rest section may be freely adjusted to various positions within its limits of travel without either binding of the various rest sections or having to move the adjustable support means in order to accommodate shifting movement of the thigh and foot rest sections.

BRIEF DESCRIPTION OF THE DRAWINGS

So that this invention is more clearly understood, reference is now made to the several accompanying drawings wherein like reference numerals refer to like parts throughout the several views, and wherein.

DETAILED DESCRIPTION OF THE PREFERRED EMBODIMENT

Figure 1:
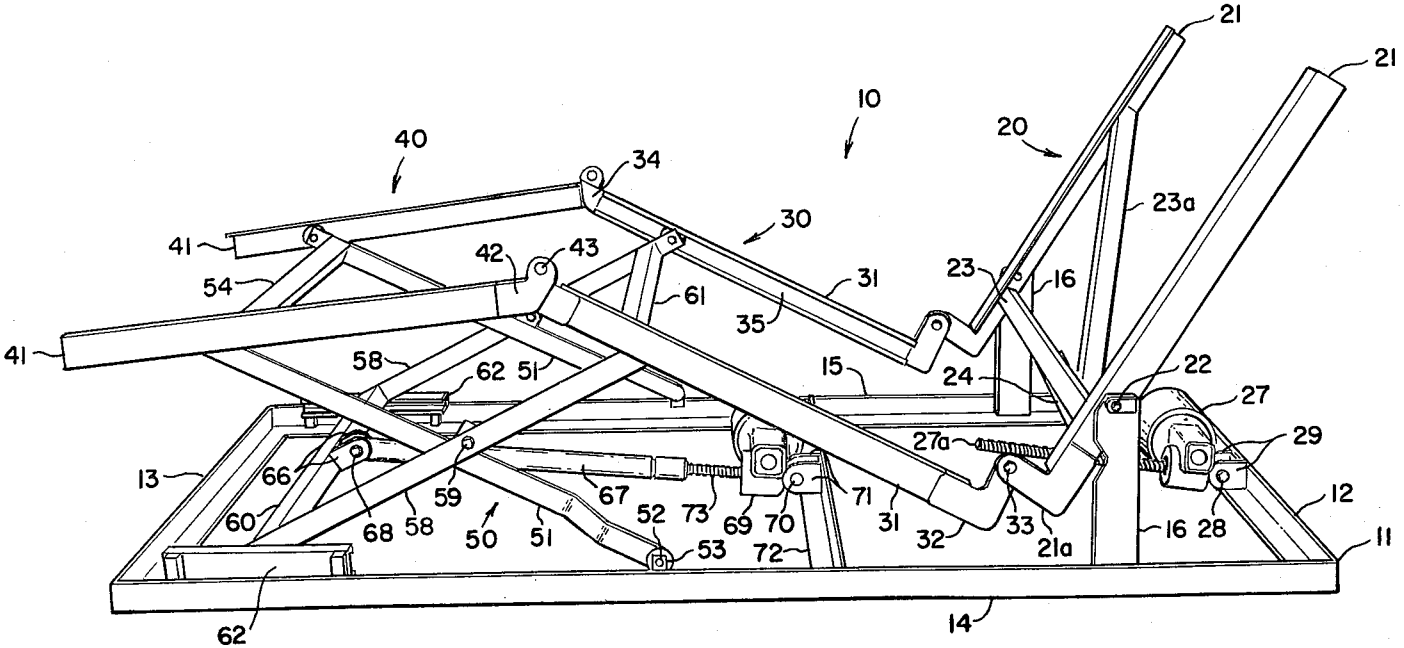
FIG. 1 is a perspective view of the preferred embodiment of this invention.

Referring to FIG. 1, therein is illustrated a perspective view of the preferred embodiment for an adjustable support frame 10 constructed in accordance with the practice of this invention. Omitted from FIG. 1 is the mattress and mattress supporting structure combination which is to be supported upon frame 10, it being understood that said combination may take many various forms and is, therefore, not considered as limiting of this invention.

More specifically, frame 10 as shown to comprise a substantially rectangular base 11 having a plurality of members welded or otherwise fixedly connected to each other to form endrails 12 and 13, and siderails 14 and 15. Fixedly secured to siderails 14 and 15 are an opposed pair of brackets 16 which project upwardly therefrom.

Surmounted over base 11 is an adjustable load-bearing portion comprising a plurality of hinged-together load-bearing sections 20, 30, and 40 which form, respectively, back, thigh, and foot rests. Stated in greater detail, load-bearing section 20, which forms said back rest, comprises a spaced-apart pair of head elements 21 pivotally connected intermediate the lengths thereof to brackets 16 by hinges 22. A cross-member 23 is fixedly connected to each of elements 21 and thereby imparts structural rigidity to the back rest section defined by section 20. As best shown by also referring to FIG. 2, projecting downwardly from cross-member 23 towards base 11 are a spaced-apart pair of brackets 24, only one of which is shown, having a threaded collar 25 of conventional design disposed therebetween and secured to each bracket 24 by hinge 26. The articulation of section 20 about the pivot axis defined by hinge 22 is provided by a motor 27 connected by hinge 28 to a spaced-apart pair of brackets 29 fixedly secured to endrail 12. A threaded axle **27*a* projects rearwardly from motor 27 and is threadably received along the free end thereof by collar 25. Optionally, various additional cross-members, such as cross-members 23*a* connected to brackets 24 and head elements 21, can be added whereby to further rigidize section 20**.

Load-bearing section 30, which forms a thigh rest, comprises a spaced-apart pair of middle elements 31 each articulably connected at one end to the adjacent end of head elements 21. As shown in FIG. 1, said articulable connection is obtained by providing upwardly projecting flange members **21*a* and 32 upon the adjacent ends of head elements 21 and middle elements 31, respectively, and then connecting said flange members in overlapping abuttment by hinges 33**.

Load-bearing section 40, forming a foot rest, similarly comprises a spaced-apart pair of foot elements 41 each articulably connected at one end thereof to the adjacent opposite end of middle elements 31. Said articulable connection is obtained by providing upwardly projecting flange members 34 and 42 upon the adjacent ends of middle elements 31 and foot elements 41, respectively, and then connecting said flange members in overlapping abuttment by hinges 43.

In the preferred embodiment each of middle elements 31 has a substantially C-shaped transverse configuration and each of head elements 21 and foot elements 41 has a substantially L-shaped transverse configuration, the purpose therefor which will be more clearly understood from the discussion which follows.

The support of load-bearing sections 30 and 40 over base 11 is provided by adjustable support means 50 communicating therebetween. Means 50 comprises a spaced-apart pair of first members 51 connected at one end thereof by hinges 52 to brackets 53 projecting upwardly from siderails 14 and 15. A cross-member 54 is included to connect said first members and thereby rigidize same.

Figure 3:
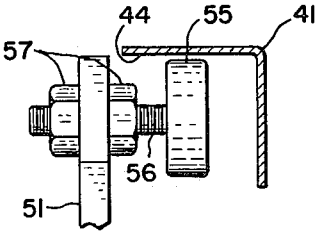
FIG. 3 is a partial, cross-sectional view taken in the direction of line 3—3 as shown in FIG. 2.

The connection of the opposite ends of first members 51 to foot elements 41 is best shown by reference to FIG. 3. More specifically, foot elements 41 are shown as having a substantially horizontal lower surface 44 which is supported upon roller 55 carried upon the distal end of an axle 56 transversely projecting from said first element and secured thereto by any suitable fastening means, such as nuts 57 or the like.

Referring back to FIG. 1, means 50 further comprises a spaced-apart pair of second members 58 connected intermediate the lengths thereof to said first members by hinges 59. Cross members 60 and 61 are included to connect said members and thereby rigidize same.

Figure 4:
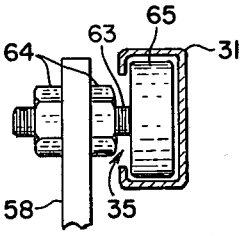
FIG. 4 is a partial, cross-sectional view taken in the direction of line 4—4 as shown in FIG. 2.

The interconnection of second members 58 to middle elements 31 and base 11 is best understood by simultaneous reference to FIGS. 1 and 4. More specifically, middle elements 31 are shown to have a substantially C-shaped transverse configuration defining a slot or channel 35 which extends along a major portion of the longitudinal dimension of said middle elements. Substantially identical slotted elements 62 are also fixedly secured, such as by welding or otherwise, in opposed relationship to siderails 14 and 15 and in longitudinal alignment therewith. Transversely projecting from each end of said second members is an axle 63 which is secured thereto by any suitable fastening means, such as nuts 64 or the like, said axle carrying upon the distal end thereof a roller 65 adapted for slideable accommodation within said slot or channel formed by elements 31 and 62.

Projecting forwardly from cross-member 60 are a spaced-apart pair of brackets 66 having an internally threaded tubular member 67 disposed therebetween and secured to said brackets by hinge 68. Articulation of said first and second members of means 50 is provided by a motor 69 connected by hinge 70 to a spaced-apart pair of brackets 71 projecting rearwardly from cross-member 72 secured to siderails 14 and 15. A threaded axle 73 projects rearwardly from motor 69 and is threadably received along the free end thereof by tubular member 67.

Figure 2:
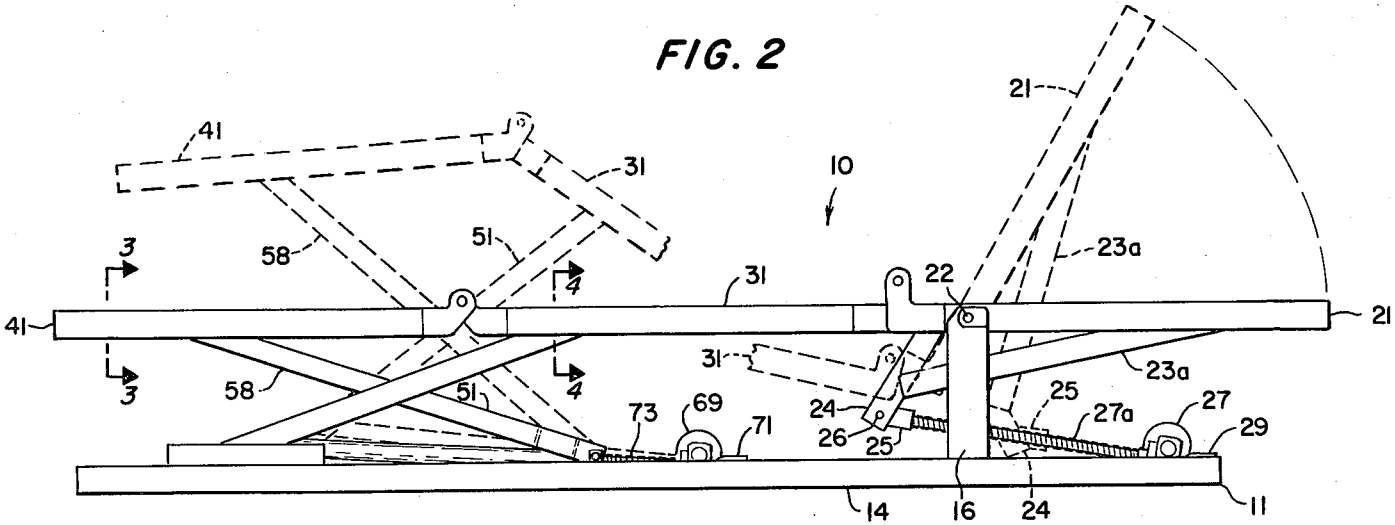
FIG. 2 is a side-view of the preferred embodiment shown in FIG. 1.

Based upon the foregoing description of the preferred embodiment, and now referring to FIG. 2, it will be appreciated that adjustable support frame 10 achieves the hereinbefore stated general object of this invention in the following manner. Preliminarily, the dimensions of brackets 16, elements 21, 31, and 41, and members 51 and 58 are each selected so that when members 51 and 58 are maintained in a first predetermined position, as shown by the solid line representation thereof in FIG. 2, elements 21, 31, and 41, respectively, are each supported in substantially longitudinal alignment with respect to each other and above base 11 in substantially spaced-parallel alignment therewith. As a consequence of the moveable manner by which members 51 and 58 support, respectively, elements 41 and 31, head element 21, may be adjustably upraised to a predetermined position of adjustment, such as indicated by the dashed line representation thereof, without elements 31 and 41 binding upon members 51 and 58.

Separately, and quite independently from element 21, elements 31 and 41 may be adjusted from said first predetermined position to a second position of adjustment, as shown by the dashed lines representative thereof, whereby element 41 is elevated and supported in substantially spaced-parallel alignment above base 11. Because elements 31 and 41 are connected to members 51 and 58 by movable abuttment connections adapted for relative movement along the longitudinal axis of said elements, elements 31 and 41 may be adjusted to any position between said first and second predetermined positions without affecting the position of adjustment of element 21.

Of course, it will be understood that rollers 55 and 65 are not limiting of this invention and that numerous alternate structures may be substituted therefor without affecting the adjustability of frame 10 as long as said alternate structures are adapted for slideable relative movement along the longitudinal axes of middle elements 31, foot elements 41, and slotted elements 62, While a preferred embodiment of the invention has been described herein, it is to be appreciated that various modifications can be made thereto without departing from the scope and essence of the invention as defined in the appended claims. Therefore, it is intended that the present specification and disclosure not be interpreted in a limiting sence and that obvious variants thereof are comprehended to be within the essence and scope of the invention.

What is claimed is:

1. In an adjustable bed or the like having a base, an articulable load-bearing portion disposed over said base, said load-bearing portion comprising a head element articulably connected to said base, a middle element articulably connected at one end thereof to the adjacent end of said head element, and a foot element articulably connected at one end thereof to the adjacent opposite end of said middle element, the improvement which comprises adjustable support means communicating between said base and each of said middle and foot elements for supporting said elements over said base and for adjusting the position of said elements relative to each other and said base without affecting the position of said head element relative to said base, the connection between said adjustable support means and said middle and foot elements permitting adjustment of said head element without movement of said adjustable support means.

2. A device as set forth in claim 1 wherein said adjustable support means is controllably adjustable from a first predetermined position wherein said middle and foot elements are supported in substantially longitudinal alignment relative to each other and substantially spaced-parallel alignment relative to said base, to a second predetermined position wherein said foot element is supported in substantially spaced-parallel alignment relative to said base and at a greater distance therefrom.

3. A device as set forth in claim 1 or claim 2 wherein said adjustable support means comprises a first member articulably connected at one end thereof to said base and abutted at the opposite end thereof against one of said middle and foot elements for relative movement along said one element, and a second member articulably connected to said first member, said second member being abutted at one end thereof against said base, and at the opposite end thereof against the other of said middle and foot elements, for relative movement along said base and the other of said elements.

4. A device as set forth in claim 3 wherein said adjustable support means further comprises a motor connected to said base and one of said first and second members.

5. A device as set forth in claim 1 further comprising means connected to said base and said head element for adjusting the position of said head element relative to said base.

6. A device as set forth in claim 5 wherein said head element adjusting means comprises a motor.

7. In an adjustable bed or the like having a base, an articulable load-bearing portion disposed over said base, said load-bearing portion comprising a head element articulably connected to said base, a middle element articulably connected at one end thereof to the adjacent end of said head element, and a foot element articulably connected at one end thereof to the adjacent opposite end of said middle element, the improvement which comprises adjustable support means communicating between said base and each of said middle and foot elements for supporting said elements over said base and for adjusting the position of said elements relative to each other and said base without affecting the position of said head element relative to said base, said adjustable support means including a first member articulably connected at one end thereof to said base and abutted at the opposite end thereof against one of said middle and foot elements for relative movement along said one element, and a second member articulably connected to said first member, said second member being abutted at one end thereof against said base, and at the opposite end thereof against the other of said middle and foot elements, for relative movement along said base and the other of said elements.

8. A device as set forth in claim 7 wherein said adjustable support means is controllably adjustable from a first predetermined position wherein said middle and foot elements are supported in substantially longitudinal alignment relative to each other and substantially spaced-parallel alignment relative to said base, to a second predetermined position wherein said foot element is supported in substantially spaced-parallel alignment relative to said base and at a greater distance therefrom.

9. A device as set forth in claim 7 or claim 8 wherein said adjustable support means further comprises a motor connected to said base and one of said first and second members.

* * * * *